US007518063B2

(12) United States Patent
Zhang et al.

(10) Patent No.: US 7,518,063 B2
(45) Date of Patent: Apr. 14, 2009

(54) POWER CORD WITH A LEAKAGE CURRENT DETECTION CONDUCTOR

(75) Inventors: Long Zhang, Shanghai (CN); Chengli Li, Shanghai (CN)

(73) Assignee: Shanghai ELE Manufacturing Corp., Shanghai (CN)

( * ) Notice: Subject to any disclaimer, the term of this patent is extended or adjusted under 35 U.S.C. 154(b) by 0 days.

(21) Appl. No.: 11/739,677

(22) Filed: Apr. 24, 2007

(65) Prior Publication Data

US 2008/0099227 A1 May 1, 2008

(51) Int. Cl.
*H01B 11/02* (2006.01)

(52) U.S. Cl. ..... 174/113 R

(58) Field of Classification Search ..... 174/113 R
See application file for complete search history.

(56) References Cited

U.S. PATENT DOCUMENTS

| | | | | |
|---|---|---|---|---|
| 2,190,017 | A * | 2/1940 | Del Mar | 174/25 R |
| 2,621,703 | A | 12/1952 | Morrison | |
| 2,864,036 | A * | 12/1958 | Steiner | 361/107 |
| 3,322,889 | A * | 5/1967 | Bird et al. | 174/113 R |
| 3,493,815 | A | 2/1970 | Hurtle | |
| 3,707,595 | A * | 12/1972 | Plate | 174/115 |
| 4,002,820 | A * | 1/1977 | Paniri et al. | 174/115 |
| 4,096,346 | A | 6/1978 | Stine et al. | |
| 4,374,299 | A | 2/1983 | Kincaid | |
| 4,398,058 | A | 8/1983 | Gerth et al. | |
| 4,755,629 | A | 7/1988 | Beggs et al. | |
| 5,530,364 | A * | 6/1996 | Mashikian et al. | 324/529 |
| RE35,561 | E * | 7/1997 | Mashikian et al. | 324/520 |
| 6,903,277 | B2 | 6/2005 | Whidden | |
| 7,166,802 | B2 * | 1/2007 | Cusson et al. | 174/113 R |
| 7,423,854 | B2 * | 9/2008 | Gandolfi et al. | 361/42 |
| 2001/0040042 | A1 | 11/2001 | Stipes | |
| 2003/0019655 | A1 | 1/2003 | Gagnon | |
| 2003/0037956 | A1 | 2/2003 | Baldock | |
| 2003/0168229 | A1 | 9/2003 | Whidden | |
| 2004/0245009 | A1 | 12/2004 | Grogl et al. | |
| 2005/0011664 | A1 | 1/2005 | Lee | |
| 2005/0077066 | A1 | 4/2005 | Stipes | |
| 2005/0085103 | A1 | 4/2005 | Driscoll et al. | |

(Continued)

OTHER PUBLICATIONS

Telecommunication cable (DS-3/4) Part No. 341213, LTK Wiring Co., Ltd., Jan. 5, 2005 (English and Chinese versions are identical to each other).

(Continued)

*Primary Examiner*—Chau N Nguyen
(74) *Attorney, Agent, or Firm*—Chen Yoshimura LLP

(57) ABSTRACT

A power cord with leakage current detection function includes three copper wires for carrying power and at least one leakage current detection conductor for detecting leakage current. Each copper wire is surrounded by an insulating layer. At least two of the insulating layers are each surrounded by a metal conductive layer. The leakage current detection conductor is adjacent and in electrical contact with the two metal conductive layers. An outer insulating layer encloses the three wires and the leakage current detection conductor. The metal conductive layers are made of a thin copper foil, tin foil, aluminum foil, or conductive rubber. The leakage current detection conductor may be formed of copper wires or aluminum wires. Such a power cord provides low cost and reliability, and can quickly and accurately detect leakage current in the cord.

4 Claims, 2 Drawing Sheets

U.S. PATENT DOCUMENTS

| | | | |
|---|---|---|---|
| 2005/0178578 | A1 | 8/2005 | Gorrell |
| 2006/0185872 | A1 | 8/2006 | Rodrigues et al. |
| 2007/0051523 | A1 | 3/2007 | Eng |
| 2007/0062721 | A1 | 3/2007 | Shatkin et al. |
| 2007/0068697 | A1 | 3/2007 | Orfin et al. |
| 2007/0087632 | A1 | 4/2007 | Fong et al. |
| 2007/0107921 | A1 | 5/2007 | Morrison et al. |
| 2007/0159740 | A1 | 7/2007 | Williams et al. |
| 2008/0007878 | A1 | 1/2008 | Gandolfi et al. |

OTHER PUBLICATIONS

GB RVVP Screened Wire, Part No. 903234-200, LTK Wiring Co., Ltd., Jan. 6, 2005 (English and Chinese versions are identical to each other).

GB RVVP Screened Wire, Part No. 903229-200, LTK Wiring Co., Ltd., Jan. 6, 2005 (English and Chinese versions are identical to each other).

GB RVVP Screened Wire, Part No. 903203-200, LTK Wiring Co., Ltd., Jan. 6, 2005 (English and Chinese versions are identical to each other).

* cited by examiner

POWER CORD WITH A LEAKAGE CURRENT DETECTION CONDUCTOR

This application claims foreign priority benefits under 35 U.S.C. §119(a)-(d) from China Patent Application No. 200620134167.8, filed Oct. 25, 2006, which is incorporated by reference in its entirety.

BACKGROUND OF THE INVENTION

1. Field of the Invention

This invention relates to a power cord. In particular, it relates to a power cord for an appliance that has a built-in leakage current detection conductor for detecting a leakage current in the power cord.

2. Description of the Related Art

With the wide use of household electrical appliances, such as air conditioners, washing machines, refrigerators, etc., more attention is being paid to the safety of using such appliances. An appliance typically has a power cord of one meters or longer. As shown in FIG. 1, such a power cord is made of three copper wires 11, 6 and 8 for carrying power, three insulating layers (made of rubber or plastic) 10, 5, and 7 surrounding the respective copper wires, two metal sheaths 19 and 14 (made of thin copper wires woven together) surrounding two insulating layer, respectively, and an outer insulating layer 1 (made of rubber or plastic) enclosing the wires.

Such a power cord may age due to long-term use, or become damaged when the appliance is moved, which may cause a leakage between the phase line and the neutral or ground lines in the cord. Such leakage current may cause sparks, which may cause fire and property damages. To quickly and accurately detect leakage current in the power cord, an additional conductor is provided and electrically connected to the metal sheath 19, 14. Leakage current can be detected by detecting a voltage on the metal sheath.

The metal sheaths are conventionally made by weaving thin copper sires. The cost of the power cord has increased due to the increase cost of the copper material.

SUMMARY OF THE INVENTION

Accordingly, the present invention provides a power cord useful for appliances such as air conditioners, washing machines, refrigerators, etc. which has a built-in leakage current detection conductor for detecting a leakage current in the power cord.

An objective of the present invention is to provide a power cord with reduced manufacturing cost.

To achieve this and other objects and in accordance with the purpose of the present invention, as embodied and broadly described, the present invention provides a power cord with leakage current detection function, which includes: three metal wires for carrying power; three insulating layers surrounding the three metal wires, respectively; at least two conductive layers surrounding two of the insulating layers, respectively; at least one leakage current detection conductor being in contact with the at least two conductive layers; and an outer insulating layer surrounding the metal wires, the insulating layers, the conductive layers and the leakage current detection conductor.

In one embodiment, one of the at least one leakage current detection conductor is located adjacent two of the at least two conductive layers and is in contact with both conductive layers. The power cord further includes a metal sheath surrounding the metal wires, the insulating layers, the conductive layers and the leakage current detection conductor, wherein the outer insulating layer surrounds the metal sheath. In another embodiment, the power cord includes two leakage current detection conductors, each leakage current detection conductor being located between one of the two conductive layers and the corresponding insulating layer.

In one embodiment, the metal wires are made of copper, the conductive layers are made of copper foil, tin foil, aluminum foil, or conductive rubber, and the leakage current detection conductor is made of copper or aluminum wires.

Advantages of power cords according to embodiments of the present invention include low cost, reliability, and the ability to quickly and accurately detect leakage current in the cord to protect safety of users and prevent damage to the appliance.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
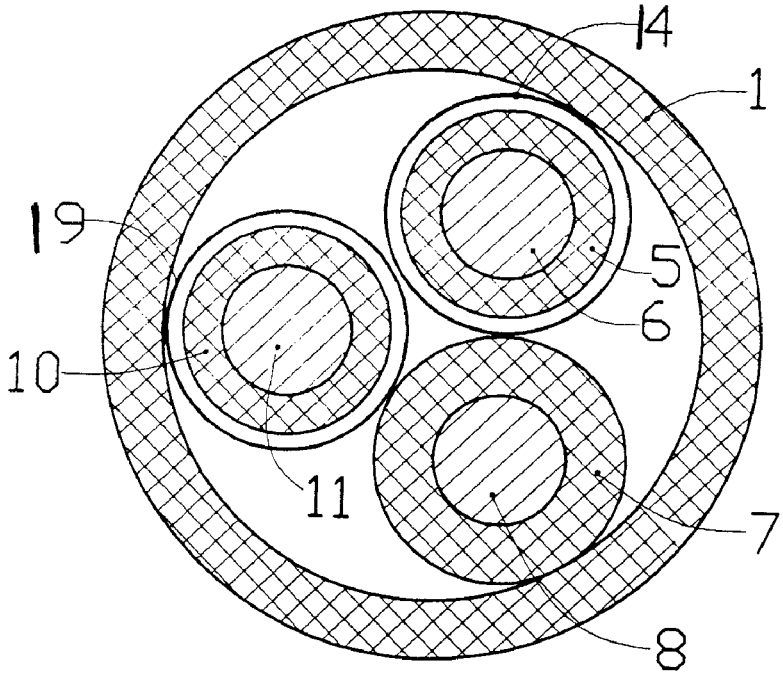
FIG. 1 (PRIOR ART)
FIG. 1 is a cross-sectional view showing the structure of a conventional power cord.
Figure 2:
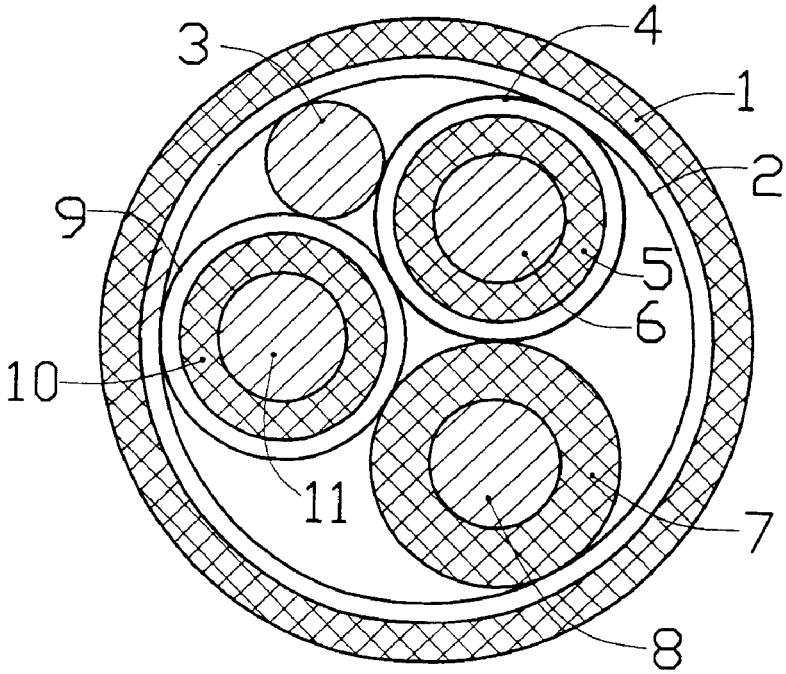
FIG. 2 is a cross-sectional view showing the structure of a power cord with a leakage current detection conductor according to an embodiment of the present invention.

As shown in FIG. 2, a power cord according to an embodiment of the present invention includes three copper wires 11, 6 and 8 for carrying power and a leakage current detection conductor 3 for detecting a leakage current in the power cord. The three copper wires 11, 6 and 8 are surrounded by three insulating layers (made of rubber or plastic) 10, 5, and 7, respectively. Two insulating layers 10, 5 are surrounded by metal conductive layers 9, 4, respectively. The leakage current detection conductor 3 is provided adjacent the two metal conductive layers 9, 4 and is in contact with both of them. A metal sheath 2 encloses the three wires with their respective insulating layers and metal conductive layers as well as the leakage current detection conductor 3. An outer insulating layer 1 (made of rubber or plastic) is provided outside of the metal sheath 2.

To reduce manufacturing cost, the metal conductive layers 9, 4 may be made of a thin copper foil, tin foil, aluminum foil, or conductive rubber. The leakage current detection conductor 3 may be formed of one or more copper wires or aluminum wires.

When leakage current is present between copper wires 11 and 6, 11 and 8, or 6 and 8, the leakage current detection conductor 3 can quickly and accurately detect the leakage current via the metal conductive layers 9 or 4.

Figure 3:
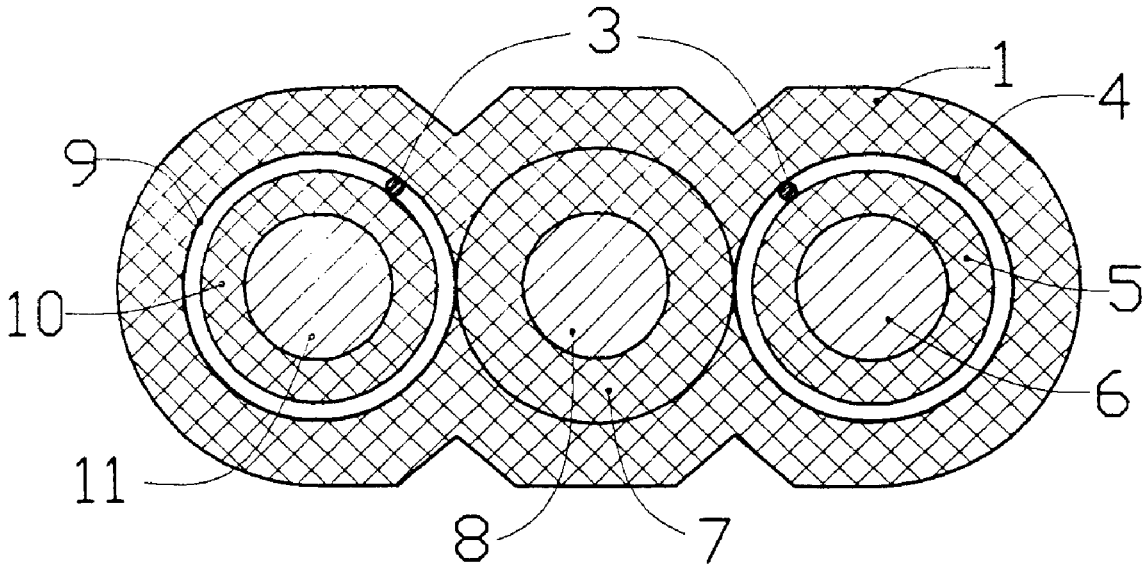
FIG. 3 is a cross-sectional view showing the structure of a power cord with leakage current detection conductors according to an alternative embodiment of the present invention.
Figure 4:
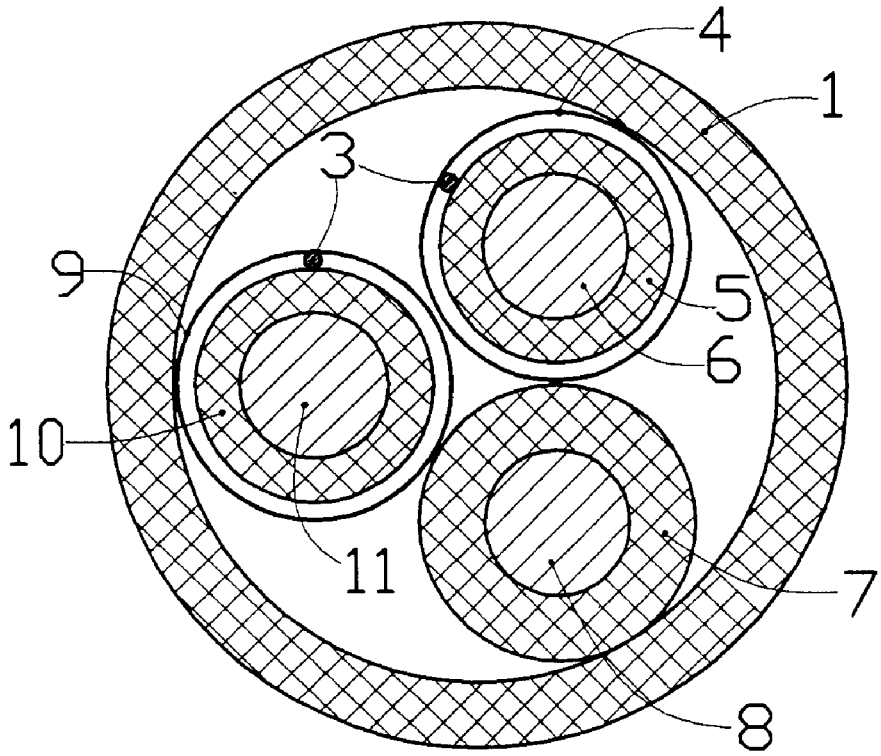
FIG. 4 is a cross-sectional view showing the structure of a power cord with leakage current detection conductors according to another alternative embodiment of the present invention.

FIGS. 3 and 4 are cross-sectional views showing the structure of a power cord with leakage current detection conductors according to alternative embodiments of the present invention. As shown in the figures, the power cord includes three copper wires 11, 6 and 8 for carrying power and two leakage current detection conductors 3 for detecting a leakage current in the power cord. The three copper wires 11, 6 and 8 are surrounded by three insulating layers (made of rubber or plastic) 10, 5, and 7, respectively. Two insulating layers 10, 5 are surrounded by two metal conductive layers 9, 4, respectively. One leakage current detection conductor 3 is provided between the metal conductive layer 9 and the corresponding insulating layer 10; another leakage current detection conductor 3 is provided between the metal conductive layer 4 and the corresponding insulating layer 5. An outer insulating layer 1 (made of rubber or plastic) encloses the wires with their respective insulating layers and metal conductive layers as well as the leakage current detection conductors 3.

To reduce manufacturing cost, the metal conductive layers 9, 4 may be made of a thin copper foil, tin foil, aluminum foil, or conductive rubber. The leakage current detection conductors 3 may be formed of one or more copper wires or aluminum wires.

When leakage current is present between copper wires 11 and 6, 11 and 8, or 6 and 8, the leakage current detection conductors 3 can quickly and accurately detect the current leakage via the metal conductive layer 9 or 4.

By changing the metal sheath used in conventional power cords, which are made by weaving thin copper wires, into a thin metal foil of copper, tin or aluminum, manufacturing cost is significantly reduced. In addition, by using the leakage current detection conductor 3, which is in contact with the metal conductive layers 9, 4, leakage current can be quickly and accurately detected.

Advantages of the present invention include low cost, reliability, and the ability to quickly and accurately detect leakage current in power cord.

It will be apparent to those skilled in the art that various modification and variations can be made in the power plug embodiment of the present invention without departing from the spirit or scope of the invention. Thus, it is intended that the present invention cover modifications and variations that come within the scope of the appended claims and their equivalents.

What is claimed is:

1. A power cord with leakage current detection function, comprising:

three metal wires for carrying power;

three insulating layers surrounding the three metal wires, respectively;

at least two conductive layers surrounding two of the insulating layers, respectively;

at least one leakage current detection conductor being in contact with the at least two conductive layers, wherein one of the at least one leakage current detection conductor is located adjacent two of the at least two conductive layers and is in contact with both conductive layers;

a metal sheath surrounding the metal wires, the insulating layers, the conductive layers and the leakage current detection conductor, the metal sheath being in contact with the conductive layers and the leakage current detection conductor; and an outer insulating layer surrounding the metal sheath.

2. The power cord of claim 1, wherein the metal wires are made of copper, wherein the conductive layers are made of a material selected from the group consisting of copper foil, tin foil, aluminum foil, and conductive rubber, and wherein the leakage current detection conductor is made of copper or aluminum wires.

3. A power cord with leakage current detection function, comprising:

three metal wires for carrying power;

three insulating layers surrounding the three metal wires, respectively;

at least two conductive layers surrounding two of the insulating layers, respectively;

two leakage current detection conductors, each leakage current detection conductor being located between one of the two conductive layers and the corresponding insulating layer; and an outer insulating layer surrounding the metal wires, the insulating layers, the conductive layers and the leakage current detection conductors.

4. The power cord of claim 3, wherein the metal wires are made of copper, wherein the conductive layers are made of a material selected from the group consisting of copper foil, tin foil, aluminum foil, and conductive rubber, and wherein the leakage current detection conductor is made of copper or aluminum wires.

* * * * *